US006579193B1

(12) United States Patent
McDowell

(10) Patent No.: US 6,579,193 B1
(45) Date of Patent: Jun. 17, 2003

(54) GOLF PUTTER, COMPONENTS THEREFOR AND METHODS OF MAKING THE SAME

(76) Inventor: Michael G. McDowell, 3530 E. Cinnamon Pl., Springfield, MO (US) 65809

( * ) Notice: Subject to any disclaimer, the term of this patent is extended or adjusted under 35 U.S.C. 154(b) by 124 days.

(21) Appl. No.: 09/654,588

(22) Filed: Sep. 1, 2000

Related U.S. Application Data

(63) Continuation-in-part of application No. 09/289,760, filed on Apr. 12, 1999, now abandoned.

(51) Int. Cl.[7] ..... A63B 69/36; A63B 53/04

(52) U.S. Cl. ..... 473/251; 473/252; 473/330; 473/313; 473/340; 473/336

(58) Field of Search ..... 473/324, 330, 473/331, 251, 252, 253, 282, 340, 341, 313, 336, 558, 559, 410, 412; D21/736, 737, 738, 739, 740, 741, 742, 743, 744, 745, 746

(56) References Cited

U.S. PATENT DOCUMENTS

| | | | | |
|---|---|---|---|---|
| 1,177,266 | A | | 3/1916 | Pedersen |
| 1,902,660 | A | | 3/1933 | Nelson |
| 3,843,122 | A | | 10/1974 | Florian |
| 3,866,922 | A | * | 2/1975 | Marci |
| 3,873,094 | A | * | 3/1975 | Sebo |
| 3,909,005 | A | | 9/1975 | Piszel |
| 3,955,819 | A | | 5/1976 | Yokich |
| D251,027 | S | | 2/1979 | Cruger |
| D264,367 | S | | 5/1982 | Gida |
| D276,452 | S | | 11/1984 | Doman |
| 4,508,342 | A | | 4/1985 | Drake |
| 4,805,922 | A | | 2/1989 | Whitfield |
| 4,819,943 | A | | 4/1989 | Szczepanski |
| 4,861,038 | A | | 8/1989 | Fucinato |
| D303,559 | S | | 9/1989 | Florian |
| 4,872,684 | A | | 10/1989 | Dippel |
| 4,913,437 | A | | 4/1990 | Newcomb et al. |
| 4,962,931 | A | * | 10/1990 | Jazdzyk |
| 5,090,698 | A | * | 2/1992 | Kleinfelter |
| 5,193,806 | A | | 3/1993 | Burkly |
| 5,308,064 | A | | 5/1994 | Jen |
| 5,362,056 | A | | 11/1994 | Minotti |
| 5,433,441 | A | | 7/1995 | Olsen et al. |
| 5,447,310 | A | | 9/1995 | Jernigan |
| D368,292 | S | | 3/1996 | Willoghby |
| 5,501,461 | A | | 3/1996 | Donofrio |
| 5,597,364 | A | | 1/1997 | Thompson |
| D381,383 | S | | 7/1997 | Brett |
| 5,690,556 | A | * | 11/1997 | Condon |
| 5,692,969 | A | | 12/1997 | Schooler |
| 5,746,664 | A | | 5/1998 | Reynolds, Jr. |
| 6,196,936 | B1 | * | 3/2001 | Meckel |

* cited by examiner

*Primary Examiner*—Sebastiano Passaniti
(74) *Attorney, Agent, or Firm*—Richard L. Marsh

(57) ABSTRACT

A cylindrical golf putter provides a better feel, better club head balance and a better visual impression for the golfer so as to improve the golfer's chances of making a successful putt. The putter shaft is inserted through the center of mass of the club head and extends nearly to the bottom side surface of the club head. The club head has a toe end and a heel end which are provided with cavities within which inserts of varying length and weight may be inserted. Sight line grooves are provided on the club head to promote visual alignment of the club head with the ball and target hole. The sight line grooves may be painted with highly contrasting paint to enhance the visual impression.

14 Claims, 4 Drawing Sheets

FIG. 2
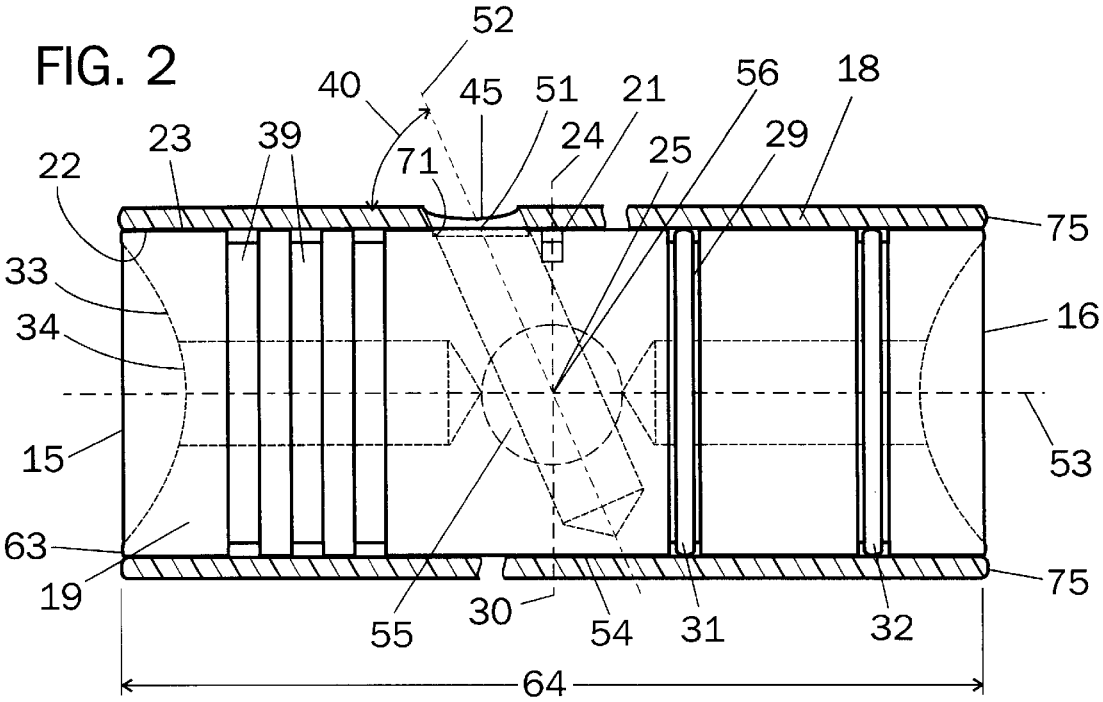
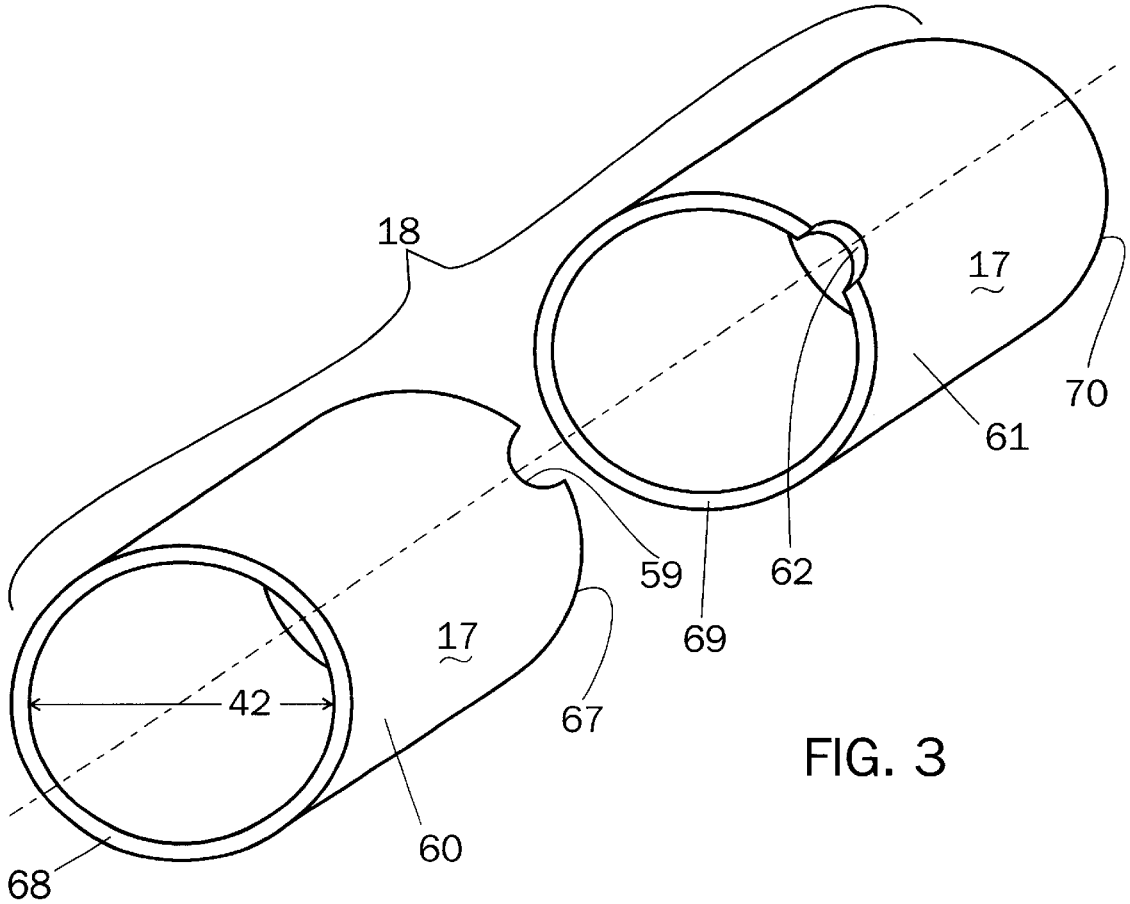
FIG. 3

GOLF PUTTER, COMPONENTS THEREFOR AND METHODS OF MAKING THE SAME

"This application is a continuation-in-part application of the parent application Ser. No. 09/289,760, filed on Apr. 12, 1999, now abandoned".

BACKGROUND OF THE INVENTION

1. Field of the Invention

This invention relates to golf clubs and preferably to a golf putter having a cylindrical head.

2. Description of the Prior Art

Putting is one of the more difficult and frustrating aspects of the game of golf. From the golfer's stance to the angle of club impact with the ball, many factors influence the success or failure of a putting stroke. The shape of the putter head, for example, can have a tremendous impact on the result of a putt. A number of mallets and golf putters have been designed with partially or generally cylindrical club heads, such as those found in the following U. S. Patents.

For instance, it is known to provide a polo mallet having a generally cylindrical head comprising two hollow parts which telescopically join wherein the handle locks the two hollow parts of the head together. U. S. Pat. No. 1,177,266 issued on Mar. 28, 1916 to B. Pedersen claims such a mallet.

Yet another generally cylindrically shaped polo mallet is disclosed in U.S. Pat. No. 1,902,660 issued on Mar. 21, 1933 to Hans Nelson wherein a wooden block is encased in a prepared cylinder of celluloid with moisture-proof plugs sealing the connection between the block and the cylinder.

It is known to provide a generally cylindrical putter head having a truncated cone toe and heel, the head further having a chordal bottom. For instance, see the U.S. Design Pat. Des. No. 264,367 issued on May 11, 1982, to Walter Gida.

It is also known to provide a generally cylindrical putter head having each of the toe and heel portions consisting of a stepped, truncated cone. For instance, see the U. S. Design Pat. Des. No. 276,452 issued on Nov. 20, 1984 to Theodore Doman.

It is further known to provide a generally cylindrical putter head having flat ends perpendicular to the axis of the cylinder. For instance, see U.S. Design Pat. Des. No. 303, 559 issued on Sep. 19, 1989 to Raymond Florian.

Still further known is a generally cylindrical putter head having a polished metal central annular band and terminal ends wherein the ends are counterbored. The putter head may be substantially hollow. For instance, see U.S. Design Pat. Des. No. 368,292 issued on Mar. 26, 1996 to Timothy Willoughby.

Another known generally cylindrical putter head is tubular and has cup-shaped elements of resilient material removable from the opposing ends of the tubular head wherein the cup-shaped members retain weights therein. For instance, see U.S. Pat. No. 3,909,005 issued on Sep. 30, 1975 to Geza Piszel.

Additionally, it is known to provide a substantially cylindrical putter head wherein the longitudinal axis of the putter head is in the putting direction wherein the putter head comprises a cupshaped first portion and a plug shaped second portion, the second portion securely fitting within the first portion. For instance, see U.S. Pat. No. 4,805,922 issued on Feb. 21, 1989 to Robert Whitfield.

Gene Fucinato, in his U.S. Pat. No. 4,861,038 issued on Aug. 29, 1989, discloses a generally cylindrical putter head having a cavity wherein most of the cavity is disposed above a centerline of the cylindrical head.

Yet another known generally cylindrical putter head is U.S. Pat. No. 4,872,684 issued on Oct. 10, 1989 to Stephanie Dippel. Dippel claims a head of acetal resin having weight-receiving receptacles in the heel and toe ends wherein the shaft is attached to the acetal resin head.

Another known patent in the art discloses a generally cylindrical putter head having a substantially cylindrical central portion and tapered bottom surfaces on the heel and toe ends. For instance, see U.S. Pat. No. 5,193,806 issued on Mar. 16, 1993 to Alfred Burkly.

An improved croquet stick having a head comprising two semi-circular half portions bonded together about an octagonal stick is claimed in U.S. Pat. No. 5,308,064 issued on May 3, 1994 to Lin Gen.

U.S. Pat. No. 5,692,969 issued on Dec. 2, 1997 to Paul Schooler discloses a putter having an adjustable shaft captured in a generally cylindrical putter head.

Those knowledgeable in the art will recognize that it is known to provide generally cylindrical putter head having a rotatable striking portion. For instance, see the U.S. Pat. No. 5,362,056 issued on Nov. 8, 1994 to Peter Minotti.

Olsen, et al., in U.S. Pat. No. 5,433,441 claims a cylindrically shaped club head comprising a thin cylindrical tube of soft and malleable material and a cylindrically shaped rod of hard material fastened throughout the length of the inside of the tube, the tube having end caps for adjusting the height between the putting surface and the center of the club head.

It is also known to provide a generally cylindrical putter head having a diameter substantially equal to the diameter of a golf ball, the center of mass of the head located at a midpoint between the toe and head on the centerline of the cylinder wherein the putter head has a plurality of spaced apart parallel slots formed circumferentially in the bottom of the head. For instance, see the U.S. Pat. No. 5,597,364 issued on Jan. 28, 1997 to James Thompson.

The art field suggests that the material of the putter head can also have a tremendous impact on the result of a putt. Mallet and golf putter heads have been designed with internal portions of wood or metal, these heads then encased in or coated with a polymeric substance. For instance, see the aforementioned U.S. Pat. No. 1,177,266 to Pedersen; U.S. Pat. No. 1,902,660 to Nelson; U.S. Pat. No. 3,909,005 to Piszel and U.S. Pat. No. 5,597,364 to Thompson.

It is also known to produce a putter head from a plastic material and insert weights in the heel and toe ends. See the aforementioned U.S. Pat. No. 4,872,684 to Dippel.

Still another generally cylindrical putter head comprising a tube of PVC pipe which has the internal passage thereof filled with weighted material wherein the weighted material placed in the heel and toe portions is greater than that in an equivalently sized center portion is claimed in U.S. Pat. No. 5,447,310 issued to Doyle Jernigan on Sep. 5, 1995.

In addition, it is known to provide a golf putter head comprising a hollow structure including a sleeve of generally rectangular cross section, filling the internal passage of the hollow structure with a light density material and inserts of preselected weight and forming a plastic shell substantially entirely around the now filled structure. For instance, see the U.S. Pat. No. 3,843,122 issued on Oct. 22, 1974 to Raymond Florian.

U.S. Pat. No. 4,508,342 issued on Apr. 2, 1985 to Robert Drake claims a golf putter having a head made of solid plastic material wherein the striking face of the putter may be an arc of a circle and Matt Donofrio, in his U.S. Pat. No. 5,501,461 issued on Mar. 26, 1996 discloses a cylindrical putter head of acetal resin having equal weights disposed in the heel and toe ends such that the putter head is centrally balanced along the longitudinal axis.

It is also known to provide a golf club formed of a translucent plastic having a chemiluminescent light stick disposed within the head. For instance, see the U.S. Pat. No. 4,913,437 issued on Apr. 3, 1990 to Newcomb, et al.

Some golfers have also relied upon a reference mark on at least the top surface of the club head to assist in squaring the putter with a sight line toward the hole. For instance, see the aforementioned U.S. Design Pat. Des. No. 264,367 to Gida and Des. No. 368,292 to Willoughby and the U.S. Pat. No. 4,872,684 to Dippel. Other golfers rely upon multiple reference marks disposed on or around the club head in order to line up each putt. For instance, see the aforementioned U.S. Pat. No. 4,805,922 to Whitfield; U.S. Pat. No. 4,861,038 to Fucinato and U.S. Pat. No. 5,692,969 to Schooler. Other putters have been constructed having a central mark for aligning the putt and multiple other reference marks. For instance the U.S. Design Pat. Des. No. 251,027 to Nicholas Cruger shows a series of equally spaced grooves in the separated top edges of the club head parallel to and on opposite sides of the central groove, Des. No. 381,383 to Colin Brett shows two parallel grooves in each of the toe and heel portions; U.S. Utility Pat. No. 3,955,819 to Bernard Yokich shows parallel white border grooves equidistant and on opposite sides of the red central groove and U.S. Pat. No. 5,746,664 issued on May 5, 1998 to Walker Reynolds, Jr., claims a plurality of parallel sighting grooves disposed on the upper surface of the head.

Finally, it is known to provide a method of teaching putting utilizing a removable pin placed on the ground and aligned with the putting line. The pin is used with multiple converging grooves on the top of a putter head for determining the amount of misalignment during a putt. For instance, see the U.S. Pat. No. 4,819,943 issued to Harry Szczepanski on Apr. 11, 1989.

None of the above patents, however, shows a club head which combines the balance, feel and visual impression provided by the putter of the present invention so as to minimize the negative consequences of poor puts and increase the golfer's chances of making a successful putt. Specifically, none of the above patents shows or suggests a golf putter comprising a club head and a club shaft wherein the club shaft has a grip end and a head end, the club head having a heel end and a toe end and at least one striking face for striking a golf ball with the striking face of the club head, the club head affixed to the head end of the club shaft, the club head having two ball centering indicia disposed thereon spaced equidistant from a theoretical sweet spot axis substantially centered on the striking face.

SUMMARY OF THE INVENTION

By the present invention there is provided a golf putter having a substantially cylindrical head wherein the head has a plurality of substantially parallel sight line grooves and an arrangement of openings into which weight inserts and the golf club shaft may be inserted so as to promote optimal club balance and feel. The substantially cylindrical shape of the putter induces the golf ball into an immediate roll as opposed to a flat putter which causes a ball to skid before rolling. Also, the plurality of sight line grooves assist the golfer in lining up the golf ball with the hole. By promoting balance, feel and visual impression, the golf putter of the present invention can significantly enhance the putting game of the golfer.

Therefore, it is a significant object of this invention to provide a golf club comprising a club head and a club shaft wherein the club shaft has a grip end and a head end, the club head having a heel end and a toe end and at least one striking face for striking a golf ball with the striking face of the club head, the club head affixed to the head end of the club shaft, the club head having two ball centering indicia disposed thereon spaced equidistant from a theoretical sweet spot axis substantially centered on the striking face.

Still another significant feature of this invention is to provide a golf club comprising a club head and a club shaft wherein the club head has a theoretical sweet spot axis aligned with a vertical axis passing through the center of mass of the club head.

Yet another object of this invention is to provide a golf club comprising a club head and a club shaft wherein the club head has two ball centering indicia disposed thereon spaced equidistant from a theoretical sweet spot axis, the two ball centering indicia comprising circumferential grooves extending substantially fully about the head.

A principal object of this invention is to provide a golf club comprising a club head and a club shaft, the club head comprising a core and an outer shell, the core having circumferential grooves extending substantially circumferentially about the core, the grooves each having an O-ring fitted therein wherein the outer shell engages the O-ring fitted in each circumferential groove thereby retaining the outer shell on the core.

It is also an object of this invention to provide a golf club comprising a substantially cylindrical club head and a club shaft wherein the club shaft has a grip end and a head end, the club head having a heel and a toe and at least one striking face for striking a golf ball with the striking face of the club head, the club head affixed to the head end of the club shaft, the club head further comprising a core and an outer shell covering at least the striking face wherein the mass of the core is greater than the mass of the outer shell.

Another object of this invention is to provide a golf club comprising a club head and a club shaft wherein the club shaft has a grip end and a head end, the club head comprising a core and an outer shell, the club head having a heel end and a toe end and at least one striking face for striking a golf ball with the striking face of the club head, the club head affixed to the head end of the club shaft wherein the centerline of the club shaft passes through the center of mass of the core.

Yet another feature of this invention is to provide a club head and a club shaft wherein the club head comprises a core and an outer shell, the core comprising substantially all of the club head.

Yet another object of this invention is to provide a club head and a club shaft wherein the club head comprises a core and an outer shell, the outer shell comprising a substantial portion of the club head.

Still another object of this invention is to provide a golf club comprising a club head and a club shaft the club head further comprising a core and an outer shell wherein the outer shell is disposed substantially over the entirety of the curved surface of the core.

Yet another object of this invention is to provide a golf club comprising a club head and a club shaft, the club head further comprising a core and an outer shell wherein the outer shell has a ball alignment indicia disposed on an interior surface thereof Those skilled in the art will recognize that a significant object of this invention is to provide a golf club comprising a club head and a club shaft, the club head further comprising a core and an outer shell wherein the core has at least one ball alignment groove disposed on an outer surface thereof, the alignment indicia protected from environmental factors by the outer shell.

A feature of this invention is to provide a golf club comprising a club head and a club shaft, the club head further comprising a core and an outer shell wherein the outer shell is substantially clear acrylic polymer.

Another feature of this invention is to provide a golf club comprising a club head and a club shaft, the club head further comprising a core and an outer shell wherein a ball alignment indicia is substantially aligned with a vertical axis passing through the center of mass of the club core, the ball alignment indicia extending substantially circumferentially about the core.

Another object of this invention is to provide a golf club comprising a club head and a club shaft, the club head further comprising a core and an outer shell wherein the outer shell is initially separate from the core.

Still another object of this invention is to provide a golf club comprising a club head and a club shaft, the club head further comprising a core and an outer shell wherein the outer shell is initially separate from the core and is applied to the core by molding the outer shell about the core.

Still another object of this invention is to provide a golf club comprising a club head and a club shaft, the club head further comprising a core and an outer shell wherein the outer shell is formed in a separate operation and mechanically applied to the core telescopically over at least a portion of the toe end of the core and may further be telescopically disposed over at least a portion of the heel end of the core and wherein the portions of the shell telescopically disposed over the toe and/or the heel end of the core extends substantially to the juncture of the core and the club shaft.

Another significant object of this invention is to provide a golf club comprising a club head and a club shaft, the club head further comprising a core and an outer shell wherein the outer shell is formed in a separate operation and mechanically applied to the core telescopically over either the toe end or the heel end of the core and wherein the shaft is disposed through the shell into the core and secured therein after disposing the shell over the core.

It is a principal object of this invention to provide a golf club comprising a club head and a club shaft the club head comprising a core and an outer shell wherein the outer shell is opened along a common seam, disposed telescopically over the core and closed about the core along the common seam of the outer shell.

Yet another object of this invention is to provide a golf club comprising a club head and a club shaft wherein the club head comprises a core and an outer shell, the core having two ball centering indicia disposed thereon spaced equidistant from a theoretical sweet spot axis, the two ball centering indicia comprising circumferential grooves extending substantially fully about the core.

Other objects and features of this invention will become apparent to the reader of the following detailed description of the invention, the appended drawings and the claims.

BRIEF DESCRIPTION OF THE DRAWINGS

FIG. 2 is a side plan view of the preferred embodiment of the club head for the golf club of FIG. 1 on the right side of the figure and an alternate embodiment of the club head on the left side.

FIG. 3 is a perspective exploded view of one embodiment of the outer shell for the club head of the golf club of FIG. 1.

DESCRIPTION OF THE PREFERRED EMBODIMENTS

While the various features of this invention are hereinafter described and illustrated as a golf club comprising a generally cylindrical club head and a club shaft wherein the club shaft has a grip end and a head end, the club head having a heel and a toe and at least one striking face for striking a golf ball with the striking face of the club head, the club head affixed to the head end of the club shaft, the club head further comprising a core and an outer shell covering at least the striking face wherein the mass of the core is substantially greater than the mass of the outer shell, it is to be understood that the various features of this invention can be used singly or in various combinations thereof to provide a golf club comprising a club head and a club shaft wherein the club head further comprises a core and an outer shell as can hereinafter be appreciated from a reading of the following description.

Figure 1:
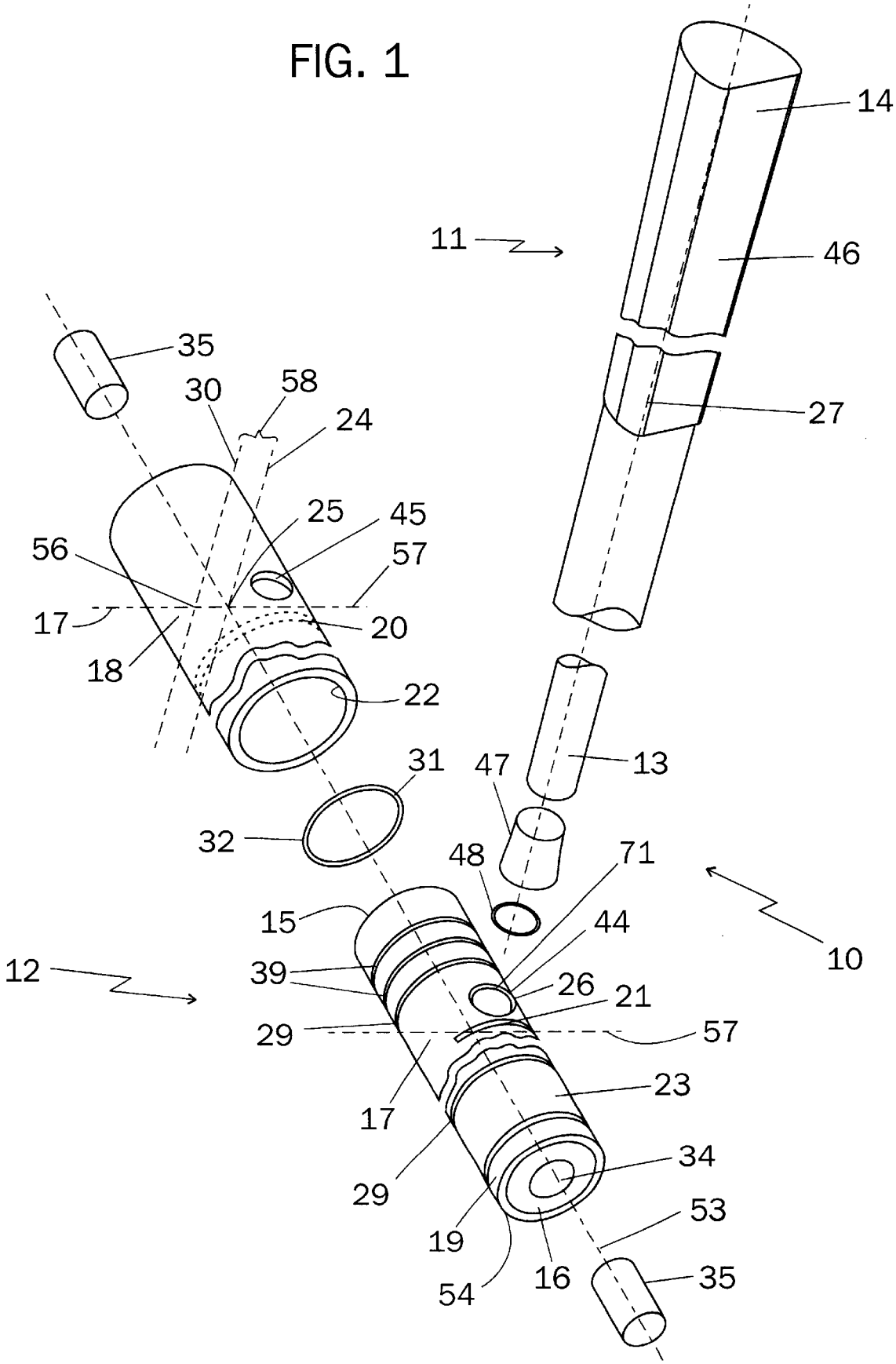
FIG. 1 is an exploded perspective view of the preferred embodiment of the golf club of this invention.

As shown in FIGS. 1 through 6, there is provided a golf putter 10 having a shaft 11 with a grip 46 fitted on grip end 14 and a club head 12 on club head end 13. Club head end 13 is affixed into substantially cylindrical club head 12, club head 12 having a toe end 16 and a heel end 15 and at least one striking face 17 for striking a golf ball with striking face 17, club head 12 further comprising a core 19 and an outer shell 18 wherein the mass of core 19 is greater than the mass of said outer shell 18. Core 19 further includes a plurality of sight line grooves 29 or 39 between toe end 16 and a shaft opening 45 and a plurality of sight line grooves 29 or 39 between heel end 15 and shaft opening 45, wherein at least one of grooves 29, 39 extends circumferentially about club head 12 intermediate core 19 and outer shell 18. Preferably, as shown in FIG. 1, outer shell 18 is disposed substantially over the entirety of the curved outer surface 23 of core 19, however, it is fully understood that outer shell 18 may be fitted on only a partial portion of core 19 as will be hereinafter fully described. Substantially cylindrical club head 12 encourages initial forward rotational spin on the ball as opposed to a flat face putter head which tends to encourage skidding of the ball before forward rotation. Golf putter 10 may be used by right-handed or left-handed golfers and club head 12 may be provided with rounded corners 63, 75 as shown in FIG. 2. Core 19 of club head 12 may be manufactured of an aluminum alloy such as aluminum alloy type 6160, for example, to obtain the best striking force, however, core 19 may also be made of any other billet of metal to achieve the putter mass as desired by a particular golfer. Shaft 11 and club head 12 are appropriately sized to decrease the negative consequences of poor putts and increase the golfer's chances of making a successful putt. In one embodiment of this invention, shaft 11 is a titanium magnesium composite alloy and is from approximately 33 inches to approximately 37 inches in length. Club head 12 is provided with an outside diameter 43 smaller than the diameter of a standard golf ball and in one embodiment of the invention has diameter 43 approximately 0.180 inch smaller than the 1.680 inch diameter of a standard golf ball, or approximately 1.50 inches. Club head 12 may be approximately 3.9 inches in length, though a longer or shorter length may alternately be advantageously used.

Figure 6:
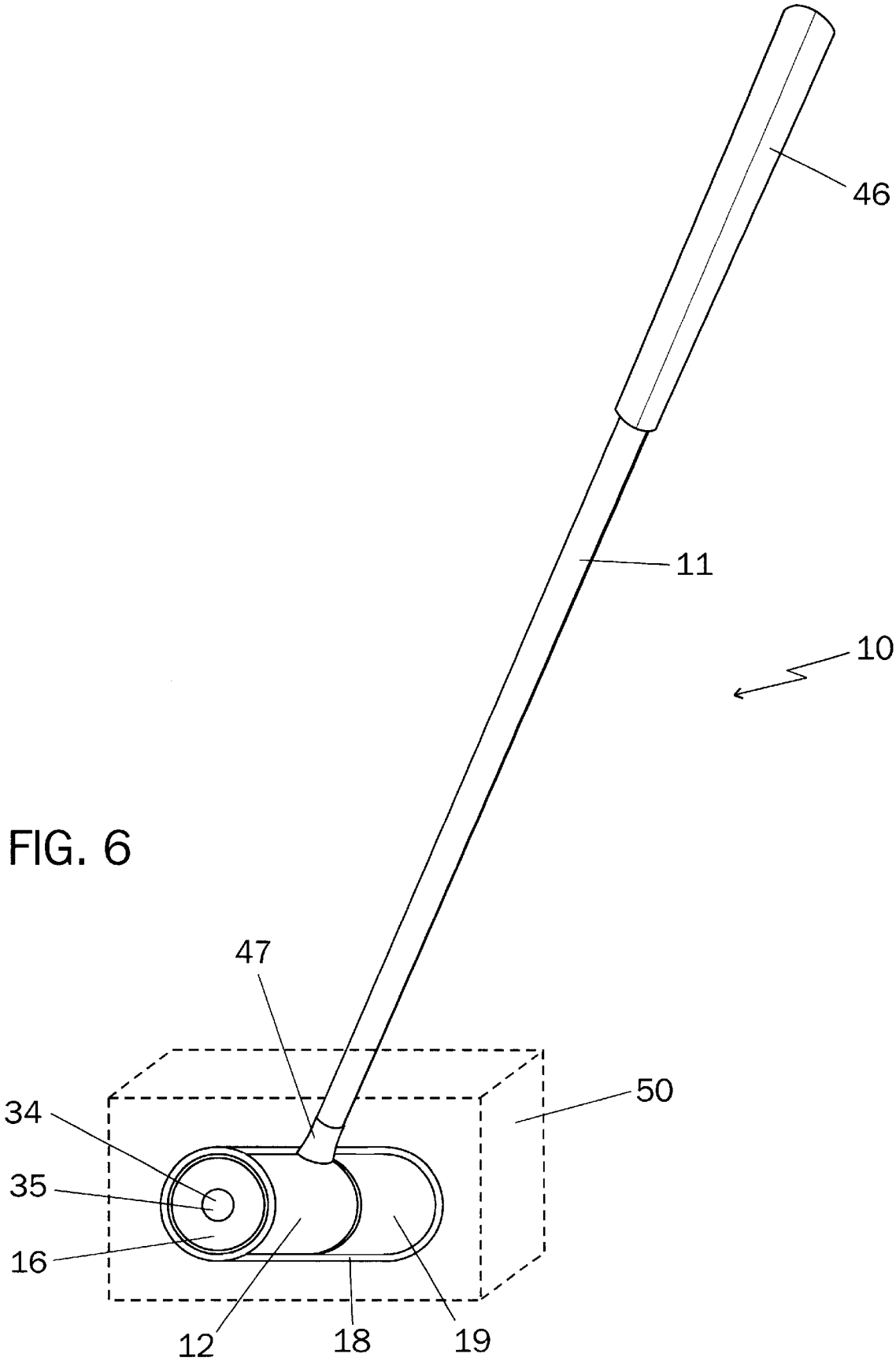
FIG. 6 is view of an alternate embodiment of the golf club of the invention showing the outer shell and hosel applied to the core and shaft in a mold.

As shown in FIGS. 1, 2 and 6, toe end 16 and heel end 15 of club head 12 are each provided with an opening or weight bore 34, each weight bore 34 extending axially into club head 12. In one embodiment of the invention, each weight bore 34 is approximately one half inch in diameter and approximately one and one half inches in depth. In this embodiment, weight bores 34 extend to within approximately 0.06 inch of a shaft opening 44. To promote proper club head balance, weight inserts 35 may be permanently pressed within weight bores 34 such as through an interference fit or may be secured within weight bores 34 using an appropriate adhesive. Weight inserts 35 may be approximately one half inch in diameter and when adapted to be adhesively secured in weight bores 34 may be one one-thousandth of an inch smaller in diameter than the diameter of weight bores 34, however, when adapted to be press fit into weight bores 34 weight inserts 35 may be one one-thousandth of an inch greater in diameter than the diameter of weight bore 34 so as to snugly fit within weight bores 34. Weight inserts 35 may be made of various materials and lengths to accommodate the needs of different golfers by providing for a different mass for each weight insert 35, however, weight inserts 35 placed in heel end 15 and toe end 16 are generally of the same material and same mass. In one embodiment of the invention, weight inserts 35 are made of copper wherein each one half inch length has a mass of one half ounce. In one embodiment of the invention, club head 12 has a mass of approximately nine ounces without weight inserts 35 placed within weight bores 34. Thus a pair of one half inch long weight inserts 35 would add one ounce to the total mass of club head 12, a pair of one inch long copper weight inserts 35 would add two ounces while a pair of one and one half inch long copper weight inserts 35 would add three ounces. Decorative nylon end caps may also be provided to enhance the overall appearance of the club.

Club head 12 of the present invention establishes a good feel and a helpful visual impression for the golfer during a putt. As shown in FIGS. 1 and 2, club head 12 is provided with peripheral sight line grooves 29 and 39 on both sides of shaft opening 44 as well as a main ball alignment groove 21 approximately halfway between heel end 15 and toe end 16 of club head 12 for alignment with a golf ball during a putt. Peripheral sight line grooves 29, 39 preferably extend circumferentially around club head 12 in substantially parallel relation. Sight line grooves 29, 39 are also substantially parallel to the desired direction of motion of club head 12 during a putt. In one embodiment of the invention, peripheral grooves 29, 39 and ball alignment groove 21 are painted in a highly contrasting paint color, such as black.

Outer shell 18 may have one of the plurality of sight line grooves 29 or 39 comprising a ball alignment indicia 20 provided on the interior surface 22 thereof, ball alignment indicia 20 disposed at least around interior surface 22 substantially aligned with and centered on vertical axis 24. Ball alignment indica 20 may comprise a groove disposed into interior surface 22, an etching upon interior surface 22 and/or a surface treatment added to interior surface 22. Preferably ball alignment indicia 20 is etched upon interior surface 22 and has a surface treatment added thereto such as contrasting colored paint or dye. Ball alignment indicia 20 may cooperate with ball alignment groove 21 in core 19 in a manner hereinafter described for ball centering indicia 29, O-ring 31, sealing ring 32 and sight line grooves 39.

Preferably, core 19 has at least one groove of the plurality of sight line grooves comprising ball alignment indicia 21 disposed on or into outer surface 23 thereof Ball alignment groove 21 is aligned with putting axis 57 and may arc around outer surface 23 along putting axis 57 approximately forty (40) degrees on either side of vertical axis 24, however, ball alignment groove 21 may extend substantially fully around outer surface 23 as a circumferential groove similar to sight line grooves 39. Putting axis 57 passes through the center of mass 25 of club head 12 extending from club head 12 along a desired line of a putt.

In one embodiment of the invention, there is a total of six peripheral sight line grooves 39, three on each side of shaft opening 44 as shown in the left half of FIGS. 1 and 2, with each peripheral sight line groove 39 being approximately one eighth inch in width and one sixteenth inch in depth and with each groove 39 in each set of three grooves being separated by approximately three sixteenths of an inch. In this embodiment, each set of three grooves is maintained within an axial length of approximately three quarters of an inch along outer surface 23 of a core 19 of club head 12. This arrangement helps to center the ball on ball alignment groove 21 of club head 12 as well as align club head 12 with putting axis 57 along the desired path of a putt. Additionally, as shown in FIG. 1, ball alignment groove 21 extends approximately 80 degrees around outer surface 23 of core 19, approximately 40 degrees to each side of a top midpoint axis 65 of core 19. In this embodiment, ball alignment groove 21 is also substantially parallel to peripheral sight line grooves 39 and is therefore also aligned with putting axis 57. Thus, sight line grooves 39 and ball alignment groove 21 are disposed on core 19 and thereafter protected from environmental factors by outer shell 18 as outer shell 18 is generally telescopically disposed lengthwise along and over core 19, internal diameter 42 of outer shell 18 substantially matching external diameter 41 of core 19. As outer shell 18 exactly matches core 19 and is press fit thereover, no space between core 19 and shell 18 is left and thus sight line grooves 39 and ball alignment groove 21 remain free of accumulated matter in contrast to the grooves provided in prior art putters. For instance, in one embodiment, core 19 is turned from an aluminum billet to an outside diameter 41 of 1.250 inches and outer shell 18 is formed to an outside diameter 43 of 1.500 inches while having inside diameter 42 formed at 1.250 inches. In another embodiment, core 19 is turned from stainless steel bar stock to an outside diameter 41 of 0.990 inch and outer shell 18 is formed to an outside diameter 43 of 1.500 inches while having inside diameter 42 formed at 0.990 inches.

It is readily apparent here that outer shell 18 is initially separate from core 19 and is applied to core 19 in an operation separate from the manufacture of core 19 or outer shell 18. In one embodiment, core 19 is affixed to shaft 11 in a manner well known in the art of making golf clubs and the structure is captured within a mold 50 as shown in FIG. 6. Thereafter, outer shell 18 is molded around core 19 and head end 13 of shaft 11, outer shell 18 fully encasing outer surface 23 of core 19 and club head end 13 of shaft 11 in the molded substance. Thus, a hosel 47 is applied to shaft 11 immediately adjacent to core 19 by the molding process. When a contrasting color is desired to be used in ball alignment groove 21 and/or any or all of sight line grooves 29, 39, the application of the color to ball alignment groove 21 and/or any or all of sight line grooves 29, 39 precedes the molding operation. Thus, the color appearing in ball alignment groove 21 and/or any or all of sight line grooves 29, 39 is also protected from environmental factors and therefore the color placed therein remains bright. Preferably, the molded substance used in the molding process to produce golf club 10 of this embodiment is a clear acrylic polymer, however, other clear polymers may be substituted and still fall within the scope of this invention. As a clear polymeric substance is used in the molding process for this embodiment, ball alignment groove 21 and all sight line grooves 29, 39, as well as any contrasting colored substances therein, are clearly visible through the clear polymeric substance and the golfer may utilize these marks 21, 29, 39 for lining up a putt.

In another embodiment, outer shell 18 is formed in a separate operation such as extrusion, molding, casting or machining a tube having an inside diameter 42 and outside diameter 43 and cut to a length 64 substantially equal to the length of core 19. Outer shell 18 may then be mechanically applied to core 19 before the securement of shaft 11 within club head 12. One way of applying outer shell 18 mechanically to core 19 is to telescopically dispose outer shell 18 longitudinally over core 19 by press fitting core 19 into outer shell 18. Core 19 may be press fitted into outer shell 18 from toe end 16 or from heel end 15 wherein core shaft hole 44 in core 19 and shell shaft hole 45 are thereafter simultaneously provided into club head 12. In this embodiment, core shaft hole 44 in core 19 and shell shaft hole 45 in shell 18 constitute a shaft hole 66 disposed into club head 12 and as club head 12 is cylindrical, with weight bores 34 centrally located on central horizontal axis 53, placement of shaft hole 66 may proceed without regard to the orientation of club head 12. Once shaft hole 66 is provided into club head 12, securement of shaft 11 may proceed in a manner well known in securing club head 12 to club shaft 11. Preferably, club shaft 11 is secured in club head 12 by an epoxy resin that acts to secure club shaft 11 into club head 12 and also to seal around juncture 26. Hosel 47 may first be applied to shaft 11 before placement of club shaft 11 into club head 12 such that a more dressed appearance to golf club 10 results.

Though it is preferred to fully encase outer surface 23 of core 19 in a single piece of clear elastomeric substance, shell 18 may be applied to only to a portion of toe end 16 by telescopically disposing a portion of a clear tube upon toe end 16. Likewise shell 18 may be applied to only to a portion of heel end 15 by telescopically disposing a portion of a clear tube upon heel end 15. FIG. 3 shows outer shell 18 as constructed in two portions, a toe portion 60 and a heel portion 61, these portions shown as half portions, toe portion 60 having an internal end 67 and an external end 68 and heel portion 15 having an internal end 69 and an external end 70 wherein when toe portion 60 and heel portion 61 are both disposed over core 19 to the full length of the respective portion thereof, internal ends 67, 69 become joined together around shaft 11. Portions 60, 61 may then be secured to core 19 in the same manner as a full length of outer shell 18 was applied to core 19 as recited above. Where full toe portion 60 and full heel portion 61 are disposed over an existing head of a golf putter and secured thereto, provision is made for receiving shaft 11 and/or hosel 47 in outer shell 18 in a substantially semi-circular cutouts 59, 62 in internal surfaces 67, 69 respectively. A sealant may be applied around semi-circular cutouts 59, 62 at assembly of half portions 60, 61 to seal juncture 26 from the elements and half portions 60, 61 may be affixed to the existing club head by press fitting and/or adhesive means.

As shown in FIGS. 1 and 2, golf club 10 comprising a club head 12 and a club shaft 11 wherein club shaft 11 has a grip end 14 and a head end 13, club head 12 comprising a core 19 and an outer shell 18, club head 12 further having a heel end 15 and a toe end 16 and at least one striking face 17 for striking a golf ball therewith, club head 12 affixed to head end 13 of shaft 11 wherein centerline 27 of club shaft 12 passes through center of mass 25 of core 19. Shaft opening 44 has a longitudinal axis 52 extending through the center of mass 25 of club head 12 at an angle 40 to the horizontal axis 53 of club head 12 wherein center of mass 25 is at the intersection of horizontal axis 53 and vertical axis 24 of club head 12. In the preferred embodiment, shaft 11 extends into club head 12 at angle 40, preferably between 60 to 90 degrees, within a distance from approximately 0.11 inch to approximately 0.13 inch of the bottom side surface 54 of core 19 of club head 12. By extending shaft opening 44 through center of mass 25 and within close proximity to bottom side 54 of club head 12, when shaft 11 is inserted into shaft opening 44, shaft 11 will be securely maintained directly behind a theoretical "sweet spot" 55 on striking surface 17, thereby imparting increased energy to the golf ball upon impact. Sweet spot 55 is defined as surrounding a point 56 on striking face 17 directly in line with center of mass 25 and spaced one half 58 of diameter 43 therefrom along a putting axis 57 and aligned with a sweet spot axis 30 lying vertically on striking face 17.

In the preferred embodiment shown in FIG. 1, shaft opening 44 extends into outer surface 23 of core 19 at a point 51 just on the heel side of vertical axis 24, however, as centerline 27 passes through center of mass 25, head end 13 of shaft 11 may actually be affixed to club head 12 at any convenient location by providing for a step or offset in shaft 11. Thus, shaft 11 may be affixed to club head 12 nearer heel end 15, or into heel end 15 parallel to weight bore 34, or into weight bore hole 34 through weight 35 by providing the appropriate offset in shaft 11 while retaining the alignment of shaft centerline 27 through center of mass 25. Referring to FIG. 2, centerline 27 is shown as passing through center of mass 25 while sweet spot 55 is shown on outer surface 23 displaced from centerline 27 by half the diameter of head 12 wherein sweet spot 55 is centered on sweet spot axis 30. The feel and balance of club 10 are largely unaffected by the placement of juncture 26 as long as centerline 27 remains aligned through center of mass 25.

Figure 4:
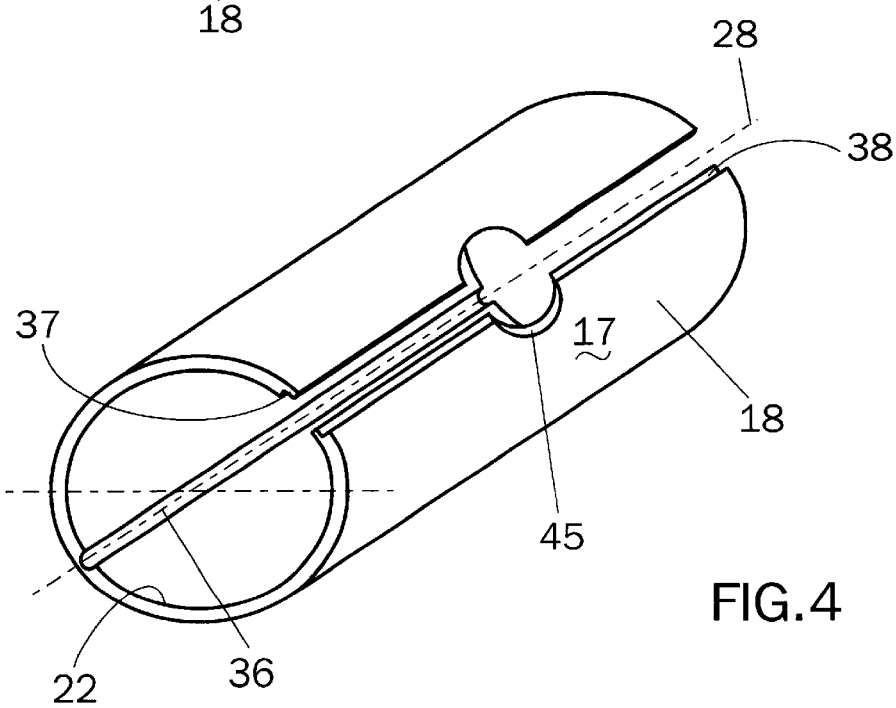
FIG. 4 is perspective view of another embodiment of the outer shell for the club head of the golf club of FIG. 1.

In the embodiment shown in FIG. 4, outer shell 18 of golf club 12 is constructed of a hollow tube split and opened along a common seam 28, disposed telescopically over core having shaft opening 45 therein disposed around club shaft 11 and closed about core 19 along common seam 28. Common seam 28 may comprise overlapping lip 37 adapted to overlie and mate with a receiving lap 38 wherein overlapping lip 37 is bonded to receiving lap 38 using an adhesive or solvent. When common seam 28 is closed about core 19 and shaft 11, a shaft sealing ring 48 is usually placed in a spot face 71 provided into outer surface 23 of core 19 concentrically around core shaft hole 44 thereby sealing shaft 11 to outer shell 18. Another spot face may be provided in outer shell 18 for receiving hosel 47 therein sealing hosel 47 to outer shell 18. Use of a spot face in outer shell 18 is particularly useful when encasing an existing cylindrical club head, now comprising core 19, in outer shell 18 to provide the novel club of this invention. Of course, shaft opening 45 shown in FIG. 3 may also be enlarged to accommodate an existing hosel 47 on an existing club head wherein the existing club head is fitted with outer shell 18 of this invention.

Generally, outer shell 18 is made of a rigid or semi-rigid thermoplastic material as hereinbefore recited and therefore, as shown in FIG. 4, outer shell 18 is provided with a longitudinal groove 36 shown substantially directly opposite split seam 28, however, longitudinal groove 36 may be disposed at any location along the internal surface 22 wherein outer shell 18 may be opened along split seam 28 and disposed over club core 19 or an existing club head, now used as core 19, and secured thereon by closing outer shell 18 about core 19. In one embodiment, outer shell 18 may comprise only a partial arc of a tube from split seam 28 to a location substantially at a location of longitudinal groove 36 wherein this partial outer shell 18 is disposed over a portion of exterior surface 23 of core 19, this partial outer shell 18 secured to core 19 by a suitable adhesive. Thus, outer shell 18 would not have overlapping lip 37 or receiving lap 38, these edges constituting the marginal edges of outer shell 18. Where this outer shell 18 is greater than a one half section, outer shell 18 may be snap fitted about external surface 23 of core 19 with one cusp of shell shaft hole 45 aligned with shaft 1I. Outer shell 18 of this embodiment may alternately or further be adhesively affixed to core 19 wherein the portion of outer shell 18 applied to outer surface 23 is used as striking surface 17. Where outer shell 18 of this embodiment is less than a one half section, outer shell 18 is adhesively affixed to external surface 23 of core 19 on the appropriate side of shaft 11 as desired by a right or left-hand golfer and thereby used as striking surface 17.

Figure 5:
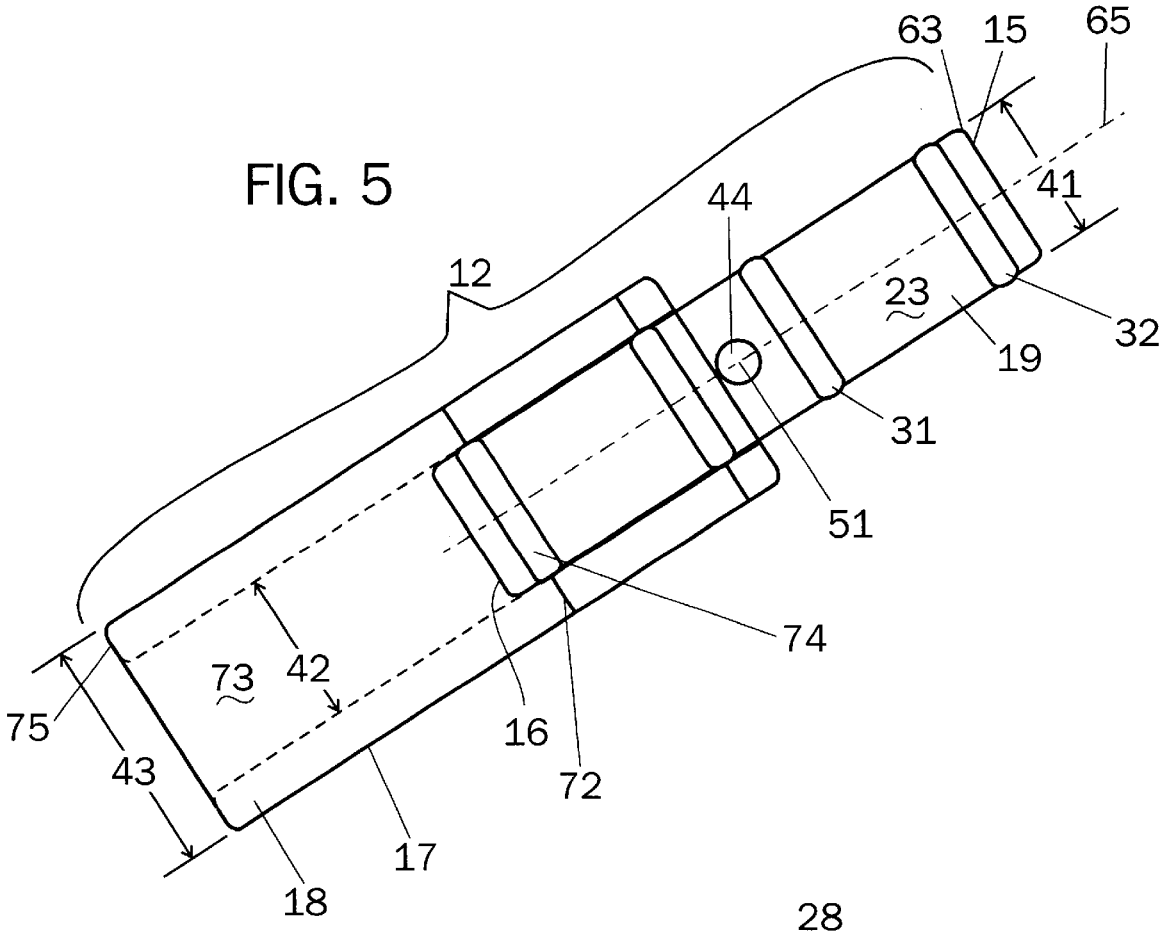
FIG. 5 is a partially exploded plan view of an alternate club head for the golf club of FIG. 1 showing the core disposed partially into the outer shell.

Referring now to the right half of FIGS. 1 and 2 and to FIG. 5, golf club 10 comprises club head 12 and club shaft 11 wherein club shaft 11 has grip end 14 and head end 13, club head 12 having heel end 15 and toe end 16 and at least one striking face 17 for striking a golf ball therewith. Club head 12 is affixed to head end 13 of club shaft 11 wherein in this embodiment club head 12 has at least two ball centering grooves 29 therein, grooves 29 spaced equidistant from theoretical sweet spot axis 30 and wherein sweet spot axis 30 is substantially centered on striking face 17. In this embodiment, there are four ball centering or putt alignment grooves 29 shown, two on each side of shaft opening 44, with each ball centering groove 29 being approximately one-eighth inch in width and one-sixteenth inch in depth though the depth and width of grooves 29 may be of another width and/or depth as selected by the manufacturer while retaining the novel features described in this invention. The inboard grooves 29 are separated by approximately one inch though this distance may be altered as desired by the manufacturer while maintaining the desired effects hereinafter described. The outboard grooves 29 are generally spaced outboard of each inboard groove 29 by approximately one inch as well, however, outboard grooves 29 may be disposed substantially at the opposite ends of length 64 just inboard of heel and toe ends 15, 16 respectively. It has been found by the teachings of this invention that grooves 29 spaced along outer surface 23 of core 19 assist in aligning club head 12 with putting axis 57 along the desired path of a putt while centering the ball between inboard grooves 29 as grooves 29 are all substantially parallel with putting axis 57. As all grooves 29 are inboard of heel and toe ends 15, 16 respectively and disposed on core 19, grooves 29 are protected from environmental factors by outer shell 18 as outer shell 18 is generally telescopically disposed lengthwise along and over core 19. Each of grooves 29 generally are circumferential grooves extending substantially circumferentially about core 19 though a lesser arc may be alternatively employed for any or all of grooves 29. Where each groove 29 extends fully about core 19, internal diameter 42 of outer shell 18 is generally greater in diameter than external diameter 41 of core 19 wherein an O-ring 31 is fitted in each inboard groove 29 and a sealing ring 32 is employed in each outboard groove 29 thereby supporting outer shell 18 spaced from core 19. For instance, in the embodiment of FIG. 5, core 19 is turned from stainless steel bar stock to an outside diameter 41 of 0.990 inch, outer shell 18 is formed to an outside diameter 43 of 1.500 inches and inside diameter 42 of outer shell is formed at 1.000 inches thus leaving a 0.005 inch clearance intermediate core 19 and outer shell 18. In this embodiment, a 1.75 mm (0.069 inch) diameter cross-section O-ring is inserted into each groove 29 before telescopically disposing outer shell 18 over core 19 thereby spacing outer shell 18 about 0.005 inch away from core 19. Thus, as O-ring 31 is disposed in core 19 and against outer shell 18, O-ring 31 now functions as ball alignment indicia 20 intermediate core 19 and outer shell 18. As exterior shell 18 engages O-ring 31 and sealing ring 32 fitted in each circumferential groove 29, outer shell 18 is thereby retained on core 19 and outer shell 18 is supported away from core 19 by O-rings 31 and sealing rings 32. Since O-rings 31 and sealing rings 32 are in contiguous contact with interior surface 22, the spaces between O-rings 31 and sealing rings 32 remain free of accumulated matter and are thus protected from elements of the environment. Once outer shell 18 is placed upon core 19, locating and drilling of shell shaft hole 45 in alignment with core shaft hole 44 may proceed. When shell shaft hole 45 has been provided through outer shell 18, shaft sealing ring 48 may be worked through shell shaft hole 45 into spot face 71 in core 19 and thereafter shaft 11 with hosel 47 thereon is permanently affixed in shaft hole 44, shaft sealing ring 48 sealing the space between inboard grooves 29 having O-rings 31 therein. Thus, the entire space between core 19 and outer shell 18 is protected from the environment.

Referring now to FIG. 5, club head 12 of golf club 10 comprises core 19 and outer shell 18, club head 12 having heel end 15 and toe end 16 and at least one striking face 17 for striking a golf ball with striking face 17, club head 12 adapted to be affixed to head end 13 of club shaft 11 wherein centerline 27 of club shaft 11 passes through center of mass 25 of core 19 and wherein outer shell 18 comprises a substantial portion of the volume of club head 12. In this embodiment, core 19 is made of a denser material such as steel, stainless steel, lead, titanium, zinc, copper or iron and thus core 19 has a greater mass than core 19 of the preferred embodiment that is made of aluminum. The volume of outer shell 18 is defined as the volume of club head 12 less the volume of core 19 wherein the volume of core 19 is determined by multiplying length 64 times diameter 41 times pi, this product then divided by four and the volume of club head 12 is similarly determined by using outside diameter 43. Since core 19 of this embodiment is smaller for a given mass, outer shell 18 is made the same outside diameter 43 but smaller in inside diameter 42 to accommodate the smaller core 19 of this embodiment. As can be observed in FIG. 5, the wall thickness of outer shell 18 is greater than the wall thickness of outer shell 18 in the preferred embodiment of FIG. 1. Though outer shell 18 of this embodiment is greater in mass than outer shell 18 of the preferred embodiment of FIG. 1, the mass of core 19 is still greater than the mass of outer shell 18. In the preferred embodiment shown in FIGS. 1 and 2, core 19 comprises a substantial portion of the volume of club head 12 as core 19 is made of aluminum or other light weight material and hence outer shell 18 has a thin wall where the thickness of the wall is defined as one half the difference between inside diameter 42 and outside diameter 43. Thus, as outer shell 18 is preferably constructed of a clear polymer and has a relatively thin wall, core 19 of the preferred embodiment is of greater mass than outer shell 18. It is readily apparent here that outer shell 18 is made to a given outside diameter 43, preferably less than the diameter of a golf ball as hereinbefore recited, and inside diameter 42 of outer shell 18 is made to be substantially equal to core outside diameter 41 and thus the material of core 19 governs inside diameter 42 of outer shell 18. The mass of club head 12 may then be altered by any weights 35 disposed in weight bores 34 where weight bores 34 are provided in core 19. Where the mass of core 19 is sufficient for club head 12, for instance, when core 19 is made of denser metals such as steel, stainless steel, lead, titanium, copper or zinc, the use of weight bores 34 may be unnecessary and thus core 19 is substantially a solid mass, though weight bores 34 may be disposed in these denser material cores 19 to alter the mass negatively, that is, to make core 19 of lesser mass. For instance, aluminum weights 35 may be used in a core 19 made of denser materials as a portion of the denser material is removed in the boring of weight bores 34 and material of lower mass may be added to this core 19 either partially or fully filling weight bores 34.

Still referring specifically to FIG. 5, it has been found by the inventor of this invention that where Wring 31 is fitted in at least the two inboard circumferential grooves 29, O-ring 31 presents an apparent narrow alignment line 72 at outside surface 73 of shell 18, alignment line 72 a refraction of light from O-ring 31 through the wall of clear outer shell 18 though O-ring 31 appears in full width as a broad line 74 when viewed directly over O-ring 31. In FIG. 5, core 19 is shown partially inserted into outer shell 18 showing the absence of apparent narrow line 72 at the left end of outer shell 18 where core 19 is absent and showing apparent narrow line 72 at the right end where core 19 is inserted. Outer shell 18 has inside diameter 42 shown as dashed lines as the inside surface 22 is not clearly visible through outer shell 18 without core 19 disposed therein, however, when core 19 is disposed therein, outside diameter 41 of core 19 presents a definitive linear surface substantially at inside diameter 42 of outer shell 18 and thus is shown as a solid line in the right-hand portion of FIG. 5. Similarly, as O-ring 31 or sealing ring 32 comes in contact with inside surface 22, apparent narrow line 72 becomes visible through the wall of outer shell 18 and O-ring 31 or sealing ring 32 shows substantially at full width only about core 19. It has been found that it is easier to square club head 12 with the ball with narrow lines 72 appearing at outside surface 73 as the distance from one narrow line 72 to the ball may be matched with the distance of the opposite narrow line 72 from the ball while broad lines 74 may be used for general alignment of club head 12 with putting axis 57 in the desired direction of a putt. More specifically, as one narrow line 72 appears on both sides of putting axis 57, narrow lines 72 may be beneficially used to more exactly square club head 12 with the ball. Where a 1.75 mm (0.069 inch) diameter cross-section O-ring is used as sealing ring 32, an additional apparent narrow line 72 and broad line 74 appears at each location of grooves 29 carrying sealing rings 32.

Grooves 29 may extend only approximately 80 degrees around outer surface 23 of core 19, approximately 40 degrees to each side of a top midpoint axis 65 of core 19 wherein in this particular embodiment, internal diameter 42 of outer shell 18 would be made substantially to match external diameter 41 of core 19. Shaft sealing ring 48 would then be disposed in spot face 71 and grooves 29 would have a contrasting color applied therein prior to assembling outer shell 18 upon core 19. Dykem enamel of an appropriate color may be used for the contrasting color applied in grooves 29.

The arrangement of heel and toe weight insert openings 34 and shaft opening 44 promotes a customized feel for the golfer as different combinations of weight inserts 35 will leave different amounts of open space within club head 12. For example, a one half in length inch insert 35 placed within heel and toe openings 34 will leave approximately one inch gaps inside club head 12 on both sides of shaft 11. This selection of weight inserts would provide a lighter club head with a more giving feel than a club head employing a pair of one and one-half inch weights 35.

In a method of making golf club 10, core 19 is preferably machined from a billet of metallic material to an external diameter 41 using a turning lathe. After turning a small radius 63 on the open end of the billet, an end face relief 33 is preferably machined into one end of core 19, end face relief 33 preferably having a smooth surface and substantially extending into core 19 by approximately 0.200 inch. Though end face relief 33 is shown as a smooth radius, other end face relief 33 configurations are contemplated within the scope of this disclosure. End face relief 33 is provided to comply with USGA rules allowing a club to have no more than two striking faces. Aluminum is used for the preferred embodiment of core 19, however, steel, iron, stainless steel alloys, copper, lead and zinc are also suitable materials. Weight bore 34, when used, is then formed into the center of the first end turned such that weights 35 may be press fit therein. Circumferential grooves 29 or 39 are turned into outer surface 23 at the specified locations and outer surface 23 is turned to a smooth finish and may be polished. The billet is then cut to length 64 and turned end for end, wherein radius 63 is provided, end face relief 33 is radiused into the square end and weight bore 34, when used, formed thereinto. As each of heel end 15 and toe end 16 have end face relief 33 disposed thereinto, no striking face is made thereby. Core shaft hole 44 may then be formed into outer surface 23 toward and through center of mass 25, core shaft hole 44 stopped short of bottom side surface 54 by approximately one-eighth of an inch. Ball alignment groove 21, when used, may then be cut into outer surface 23 ahead of core shaft hole 44 and aligned on vertical axis 24, ball alignment groove 21 milled into outer surface 23 using an end mill in a milling collet while core 19 is moved into engagement with the end mill on a radius greater than the radius of core 19. Spot face 71 is also milled into outer surface 23 concentrically aligned with core shaft hole 44, spot face extending into outer surface 23 less than the thickness of sealing ring 48. Weights 35 are generally cut from a length of smooth solid copper rod to the length desired by the golfer or as selected by the manufacturer to make a multitude of clubs of one weight. Thereafter, one weight 35 may be press fit into each weight bore 34.

Outer shell 18 has internal bore 42 formed into a length of clear acrylic tubing by turning internal bore 42 to a precise diameter. External diameter 43 is also turned on the turning lathe to provide for an exact diameter and smooth outside surface 73. Outer shell 18 is then cut to length and readied for installing over core 19. A forming tool may then be moved into engagement with each end of outer shell 18 to form radiused ends 75. Though it is preferred to turn outer shell 18 in a machining operation, it is possible to extrude or cast outer shell 18 in an extruding or molding operation. When outer shell 18 has been completed, sealing ring 48 is installed in spot face 71 and depressed slightly while outer shell 18 is press fit over core 19 and as the length 64 of core 19 is substantially the same as length 64 of outer shell 18, club head 12 is substantially complete. Outer shell shaft hole 45 is then provided through the wall of outer shell 18 aligned with core shaft hole 44 thus completing shaft hole 66 and a commercially available club shaft 11 is selected for placement therein. Club shaft 11 has hosel 47 placed on head end 13 thereof and head end 13 is then inserted into shaft hole 66 and secured therein with an epoxy adhesive. Hosel 47 is also secured to shaft 11 and club head 12 with the epoxy adhesive. Grip 46 is then applied to grip end 14 of club shaft 11 and club 10 is complete.

This invention may be embodied in other specific forms without departing from the spirit or essential characteristics thereof The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed and desired to be secured by Letters Patent is:

1. A golf putter, comprising a shaft having a grip end and a club head end; a generally cylindrical club head having an outer surface, a heel end, and a toe end, said club head including a shaft opening for receiving said shaft, said outer surface having at least one striking face for striking a golf ball with said striking face of said club head, said club head affixed to said head end of said club shaft said club head further comprising a core and an outer shell, said outer shell covering at least said striking face wherein the mass of said core is greater than the mass of said outer shell, said core further including a plurality of sight line grooves between said toe end and said shaft opening and a plurality of sight line grooves between said heel end and said shaft opening, at least one of said grooves extending circumferentially about said club head intermediate said core and said outer shell.

2. A golf club as in claim 1 wherein said outer shell is initially separate from said club head and is disposed substantially over the entirety of the curved surface of said core at assembly of said core with said outer shell.

3. A golf club as in claim 1 wherein said at least one of said plurality of sight line grooves comprises a ball alignment indicia disposed on an interior surface of said outer shell.

4. A golf club as in claim 1 wherein said at least one of said plurality of sight line grooves comprises a ball alignment indicia disposed on an outer surface of said core, said ball alignment indicia protected from environmental factors by said outer shell.

5. A golf club as in claim 4 wherein said ball alignment indicia is substantially aligned with a putting axis passing through the center of mass of said club head, said ball.

6. A golf club as in claim 2 wherein said outer shell is formed in a separate operation and mechanically applied to said club head.

7. A golf club as in claim 6 wherein said shell is telescopically disposed over at least a portion of said toe end of said club head.

8. A golf club as in claim 6 wherein said shell is telescopically disposed over at least a portion of said heel end of said club head.

9. A golf club as in claim 7 wherein said portion of said shell telescopically disposed over said toe end of said club head extends substantially to the juncture of said club head and said club shaft.

10. A golf club as in claim 8 wherein said portion of said shell telescopically disposed over said heel end of said club head extends substantially to the juncture of said club head and said club shaft.

11. A golf club as in claim 1 wherein said outer shell is generally greater in internal diameter than an external diameter of said core wherein a sealing ring is fitted in at least two of said plurality of sight line grooves, said sealing rings thereby supporting said outer shell in a spaced relationship from said core.

12. A golf club as in claim 11 wherein said at least two of said plurality of sight line grooves are disposed adjacent a terminal end of said heel end and a terminal end of said toe end.

13. A golf club as in claim 11 wherein said at least two of said plurality of sight line grooves comprise ball centering grooves spaced equidistant from a theoretical sweet spot axis passing through the center of mass of said club head.

14. A golf club comprising a club head and a club shaft wherein said club shaft has a grip end and a head end, said club head having a heel end and a toe end and at least one striking face for striking a golf ball with said at least one said striking face of said club head, said club head affixed to said head end of said club shaft, said club head having two ball centering indicia disposed thereon spaced equidistant from a theoretical sweet spot axis substantially centered on said striking face, said club head comprising an outer shell and an internal core, said internal core having a plurality of circumferential grooves disposed therearound for receiving sealing rings therein, said sealing rings disposed between said internal core and said outer shell wherein said two ball centering indicia comprise sealing rings disposed in two of said grooves.

* * * * *